US011613857B2

(12) United States Patent
Cronk

(10) Patent No.: US 11,613,857 B2
(45) Date of Patent: Mar. 28, 2023

(54) BRIDGES

(71) Applicant: PEARSON ENGINEERING LTD, Tyne and Wear (GB)

(72) Inventor: Richard Cronk, Tyne and Wear (GB)

(73) Assignee: Pearson Engineering Limited, Newcastle Upon Tyne (GB)

( * ) Notice: Subject to any disclaimer, the term of this patent is extended or adjusted under 35 U.S.C. 154(b) by 0 days.

(21) Appl. No.: 17/059,933

(22) PCT Filed: May 20, 2019

(86) PCT No.: PCT/GB2019/051391

§ 371 (c)(1),
(2) Date: Nov. 30, 2020

(87) PCT Pub. No.: WO2019/229418

PCT Pub. Date: Dec. 5, 2019

(65) Prior Publication Data

US 2021/0207331 A1 Jul. 8, 2021

(30) Foreign Application Priority Data

May 31, 2018 (GB) ..... 1808872

(51) Int. Cl.
*E01D 15/12* (2006.01)
*E01D 15/127* (2006.01)

(52) U.S. Cl.
CPC ..... *E01D 15/127* (2013.01); *E01D 15/124* (2013.01)

(58) Field of Classification Search
CPC ..... E01D 15/124; E01D 15/127
USPC ..... 14/2.4, 2.5, 77.1
See application file for complete search history.

(56) References Cited

U.S. PATENT DOCUMENTS 925,922 A * 6/1909 Knapke et al. ..... B66F 11/04 182/62.5
960,022 A * 5/1910 Kelemen et al. ..... E01D 2/02 14/77.1
2,556,175 A * 6/1951 Frost ..... E01D 15/127 254/326
3,105,251 A 10/1963 Stevens, Jr. et al.
4,635,311 A * 1/1987 Helmke ..... E01D 15/127 182/63.1
4,853,998 A 8/1989 Bernard et al.
4,972,538 A * 11/1990 Parramore ..... E01D 15/127 14/2.4

(Continued)

FOREIGN PATENT DOCUMENTS

DE 3205563 A1 8/1983
DE 20021451 U1 5/2001

(Continued)

OTHER PUBLICATIONS

International Search Report and Written Opinion dated Sep. 11, 2019 for PCT/GB2019/051391.

(Continued)

*Primary Examiner* — Raymond W Addie
(74) *Attorney, Agent, or Firm* — Banner & Witcoff, Ltd.

(57) ABSTRACT

A deployable bridge carried on or by a vehicle, the bridge being movable from a stowed position to a deployed position, in which a bridge launch mechanism is provided and has only a single actuator.

20 Claims, 11 Drawing Sheets

(56) References Cited

U.S. PATENT DOCUMENTS

| | | | | |
|---|---|---|---|---|
| 5,173,981 | A * | 12/1992 | Hasselkvist | E01D 15/133 14/2.4 |
| 2008/0163439 | A1 | 7/2008 | Green | |
| 2009/0106917 | A1* | 4/2009 | Richeux | B60F 3/0061 440/12.5 |
| 2009/0282625 | A1* | 11/2009 | Homsi | E01D 2/02 14/77.1 |
| 2010/0031454 | A1* | 2/2010 | Deschamps | E01D 15/133 14/2.4 |
| 2012/0074035 | A1 | 3/2012 | Deschamps | |
| 2012/0213625 | A1 | 8/2012 | Roberts | |

FOREIGN PATENT DOCUMENTS

| | | | |
|---|---|---|---|
| EP | 0353552 | A2 | 2/1990 |
| FR | 2834524 | A1 | 7/2003 |
| WO | 8505389 | A1 | 12/1985 |
| WO | 2012083943 | A2 | 6/2012 |

OTHER PUBLICATIONS

GB1808872.4 search report dated Feb. 27, 2019.
GB1808872.4 search report dated Nov. 22, 2018.

* cited by examiner

BRIDGES

This application is a U.S. national phase of International Patent Application No. PCT/GB2019/051391, filed on May 20, 2019, which claims priority to British Patent Application No. 1808872.4, filed on May 31, 2018. All of the aforementioned applications are hereby incorporated herein by reference fully in their entireties.

The present invention relates generally to bridges and particularly, although not exclusively, to temporary bridges which are deployable from a vehicle.

Temporary bridges are often transported on, and launched from, military vehicles. This approach can have some disadvantages:

- the vehicles need to be specially adapted for this role, possibly making them unable to perform other military roles e.g. a battle tank chassis may have its gun removed to fit a bridge stowage and launching mechanism meaning it can no longer function as a battle tank.
- the bridge can either be stowed above the vehicle, which raises the height of the combined centre of gravity making the vehicle with bridge less stable and prone to toppling over or the bridge may be stowed lower and to the side of the vehicle, making the vehicle excessively wide and unable to negotiate narrow routes.
- during the launching sequence the mass of the vehicle has to counterbalance the mass of the bridge. A 'see-saw' is created with the vehicle mass on one side and the bridge mass on the other, the pivot point between them generally being some kind of support foot which is extended to touch the ground. To be lightweight and compact this support foot cannot be very long. Military bridges are, however, often long (to bridge wide gaps) and their centres of gravity are generally at mid span. They are also heavy (because they have to be strong enough to support heavy military vehicles). The result of large mass times the large distance of the C of G from the pivot point is a large moment applied to the 'see-saw'. To balance this a very heavy vehicle is required because military vehicles (and the support foot) are generally short compared to the bridge dimensions so their C of G is closer to the pivot.

There are many examples of military bridge deploying mechanisms. EP225I486 is illustrated in FIG. 10 and is one method which uses two hydraulic cylinders (34 & 36) to deploy a stabilising foot and two further cylinders (28 & 30) to deploy the bridge structure. two cylinders are required for each element because both motions require approximately 180° of rotation. A complex control mechanism is required to sequence each actuator to achieve the required articulation with the four actuators and the whole system is both complex and heavy.

Another example of a bridge launching mechanism is illustrated in U.S. Pat. No. 4,225,280 and in FIG. 11. In this mechanism two actuators are used, one (14) used to tip the bridge up to an angle suitable for deployment and a second powered conveyer mechanism used to subsequently deploy the bridge. A control mechanism is required to sequence the actuators. This particular mechanism is for floating bridges and not necessarily suitable for bridges over dry gaps.

The present invention seeks to provide improvements in or relating to deployable bridges.

In one aspect the present invention provides a mobile bridge system comprising a vehicle and a trailer which can be towed and/or pushed by the vehicle, a deployable bridge being provided on or by the trailer.

The bridge may be movable from a stowed position on the trailer to a deployed position, for example by an onboard deployment mechanism.

In some embodiments the bridge is a single section; in other embodiments the bridge comprises two or more bridge sections (which may, for example, by articulated with respect to each other e.g. by a pivot).

In some embodiments a bridge launch mechanism is provided and has only a single actuator. In other words the actuation mechanism may consist of only a single actuator.

The or at least one of the bridge sections may be inverted during deployment. Therefore the or at least one of the sections may be stored "upside down" and flipped the right way up during deployment.

The bridge may be carried on a stowage pallet. The stowage pallet may be pivotably connected to the trailer so as to be rotatable about a single point; the or one of the bridge sections may be pivotably connected to the pallet.

The present invention also provides a deployable bridge carried on or by a vehicle, the bridge being movable from a stowed position to a deployed position, in which a bridge launch mechanism is provided and has only a single actuator.

The bridge may comprise two or more bridge sections

The bridge may be carried on a stowage pallet. The stowage pallet may be pivotably connected to the vehicle so as to be rotatable about a single point; the or one of the bridge sections may be pivotably connected to the pallet.

The vehicle may be a military vehicle. Alternatively the vehicle may be a trailer which can be towed and/or pushed by a powered vehicle such as a tank.

The present invention also provides a military bridge deployment system comprising an armoured vehicle and a lightweight trailer, a deployable bridge being provided on or by the trailer. A bridge launch mechanism consisting of a single actuator to achieve bridge launch may be provided.

The present invention recognises that bridge launching is essentially a single degree of freedom problem and achieves bridge launch with a single actuator which does not require a sequencing control mechanism.

An objective of some aspects and embodiments of the present invention is to transport and launch military bridges from a lightweight towed trailer using a simple mechanism.

In some aspects and embodiments the present invention provides a trailer bridge launch mechanism.

In some aspects and embodiments the present invention provides a bridge launch mechanism consisting of a single actuator to achieve bridge launch.

Achieving launch with a trailer/mechanism which can be light weight because the vehicle mass is used as ballast and this is moved to a much greater offset from the pivot point of the system 'see-saw'.

In some aspects and embodiments the present invention utilises a separate trailer for transporting and launching bridges. The trailed can be towed (or pushed) by any vehicle with a suitable hitch point—the vehicle does not need significant modification and can perform other roles when not involved in bridge deployment. The vehicle C of G is not affected and the trailer with stowed bridge can be designed with a low C of G so both have good stability. The combined system is narrow and can articulate so can negotiate narrow routes. Finally the configuration of vehicle and trailer can be used to make a long 'see-saw' with the vehicle C of G a large distance from the pivoting point thus a lighter vehicle and a light weight trailer can be used that still achieves sufficient moment to balance the bridge. Thus a trailer has many advantages, although it will be appreciated that the mechanism can, however, equally be used directly on a vehicle chassis.

Some aspects of the present invention provide an armoured vehicle-launched bridge (AVLB) which may be, for example, a tracked vehicle converted from a tank chassis to carry a folding bridge instead of weapons.

In some embodiments the bridge unfolds, providing a ready-made bridge across an obstacle. Once the span has been put in place, the vehicle detaches from the bridge, and moves aside to allow traffic to pass. Once all of the vehicles have crossed, it crosses the bridge itself and reattaches to the bridge on the other side. It then retracts the span ready to move off again.

In some embodiment the bridge can be folded and stowed on a transporting trailer.

The bridge may be impaled onto a bridge interface probe and supported on a bridge support.

The vehicle and trailer chassis may both sit on sprung suspensions which connect to wheels/tyres.

A single linear actuator may be provided and take the form of a long powered leadscrew, which may run horizontally and the whole length of a trailer and may be an integral part of the trailer chassis.

A pivot joint may be connected to the lead screw so it can be moved the whole length of the trailer (e.g. from front to back of the trailer chassis). As the leadscrew moves the pivot it can push a connecting link rearward. This causes the bridge stowage pallet, bridge and the bridge interface probe to pivot around the joint.

It may be significant that a line drawn along the axis of the connecting link is below the pivot joint so the connecting link is trying to rotate the bridge interface probe anticlockwise.

A pivot may be arranged to bare down upon the bridge stowage pallet so that it cannot rotate anticlockwise from this location so the whole assembly is forced to rotate around pivot and lift up.

In use the leadscrew may continue to move the pivot rearwards in the deployment sequence.

Even after a line along the connecting rod axis passes above the pivot the mechanism may continue to rotate as an assembly (bridge, bridge pallet, interface probe) about the pivot because the bridge mass and centre of gravity provides sufficient anticlockwise moment to exceed the clockwise moment provided by the connecting link.

Once the stowage pallet has rotated sufficiently that its extreme end touches the ground and becomes a supporting foot, the system may be configured such that the stowage pallet cannot rotate much beyond this point.

In use the bridge and interface probe may start to rotate about the pivot because the stowage pallet is prevented from further rotation. The bridge is then caused to lift off its support.

Unfolding of the bridge might be caused by a connected mechanical system (discussed in optional features below), by a hydraulic system or by some other means. The bridge C of G may be still forwards of the supporting foot; the connecting rod may be in compression pushing the bridge up and the weight of the bridge can bear down on the supporting foot and on the trailer.

The bridge centre of gravity can be moved rearwards of the supporting foot. The connecting rod may now be in tension so it is lifting the trailer chassis.

The trailer suspension may be compressed (the wheels are above the chassis lower edge), The trailer suspensions may be caused to extend (the wheels are below the trailer chassis lower edge).

As the bridge deploys further, there might be a danger that the trailer chassis lifts sufficiently or that the foot depresses into soft ground such that the supporting foot over rotates under the chassis. A rotation stop may be provided to prevent this.

In some embodiments, the trailer mass can be minimised because the 'see-saw' can be balanced by a vertical force generated at the trailer to vehicle hitch lifting the rear of the vehicle. The vehicle suspension may extend accordingly (the vehicle rear wheel can be seen extended slightly from the vehicle chassis.

The rear of the vehicle may be caused to lift more, with its rear suspension is extending further. If the vehicle is very lightweight its rear end may be lifted clear of the ground and the 'see-saw' may collapse. However, by adding a chain the possibility of this happening can be avoided. In a most highly loaded position, with the bridge just about to land, the chain may be pulled tight so the see-saw is trying to lift the whole mass of the vehicle, not just it's rear end.

When the bridge on the ground (or crossing a gap) the mechanism is no longer supporting the bridge and has unloaded. Vehicle and trailer suspensions may return to their normal positions and the chain may be slack. The vehicle and trailer combination can now move forwards which may disengage the interface probe from the bridge.

Bridge recovery may be achieved by reverse of bridge launch sequence.

The present invention also provides or relates to methods of deploying/recovering a bridge as described herein.

Optional Features

The system could be fitted directly onto a vehicle rather than on a trailer

The chain (7) may not be required if the vehicle is sufficiently heavy.

The system can launch single piece bridges or two (or more) piece 'scissor' bridges.

When launching scissor bridges (as shown in this embodiment), the bridge opening could preferably be powered and controlled by the single actuator of the bridge launch mechanism. Scissor bridges currently in service typically have an integral hydraulic cylinder used to open and close them. This is connected to the bridge launching vehicle by a quick connect/disconnect hydraulic hose connection. During the launch, the launching vehicle supplies hydraulic oil to the bridge cylinder which extends or contracts and possibly via cables and pulleys opens the bridge from its folded arrangement to its deployed shape. This has several disadvantages. The hydraulic connections which are made and broken during each launch/recover must be kept clean to avoid contamination of the oil which can damage hydraulic systems leading to their failure. The supply of the oil needs to be timed accurately to ensure the bridge opens/closes at the correct time. Numerous vehicles may launch numerous bridges which will result in cross contamination of oil present in the vehicles and the bridges. Hydraulic oil need periodic renewal and this cross contamination makes it impossible to know when this should occur. Hydraulic oil viscosity varies with temperature and can be excessively viscous at very low temperature. A 'warm' vehicle recovering a 'cold' bridge will have to circulate oil of very different temperature and viscosity which may require more complex valves or controls. Thus an optional addition to the single actuator bridge launch mechanism described here is a scissor bridge with integral leadscrew instead of the traditional hydraulic cylinder. This leadscrew may be powered via a direct mechanical power take of (PTO) drive from the launching mechanism. The whole system is thus mechanically geared together and the timing of the sequence is thus fixed to the operation of the single powering actuator.

The term "carried on or by a vehicle" may include the bridge being on the actual host vehicle and/or being on a trailer towed or pushed by a vehicle.

The term "vehicle" may cover a bridge on a powered vehicle, or on a trailer (the vehicle) that is pushed/pulled by something else.

Different aspects and embodiments may be used together or separately.

The present invention is more particularly shown, by way of example, with in the accompanying drawings.

The example embodiments are described in sufficient detail to enable those of ordinary skill in the art to embody and implement the systems and processes herein described. It is important to understand that embodiments can be provided in many alternate forms and should not be construed as limited to the examples set forth herein.

Accordingly, while embodiments can be modified in various ways and take on various alternative forms, specific embodiments thereof are shown in the drawings and described in detail below as examples. There is no intent to limit to the particular forms disclosed. On the contrary, all modifications, equivalents, and alternatives falling within the scope of the appended claims should be included.

Elements of the example embodiments are consistently denoted by the same reference numerals throughout the drawings and detailed description where appropriate.

Unless otherwise defined, all terms (including technical and scientific terms) used herein are to be interpreted as is customary in the art. It will be further understood that terms in common usage should also be interpreted as is customary in the relevant art and not in an idealised or overly formal sense unless expressly so defined herein.

One of ordinary skill in the art will appreciate the many possible applications and variations of the present invention based on the following examples of possible embodiments of the present invention.

The following is a brief description of the drawings.

Figure 1:
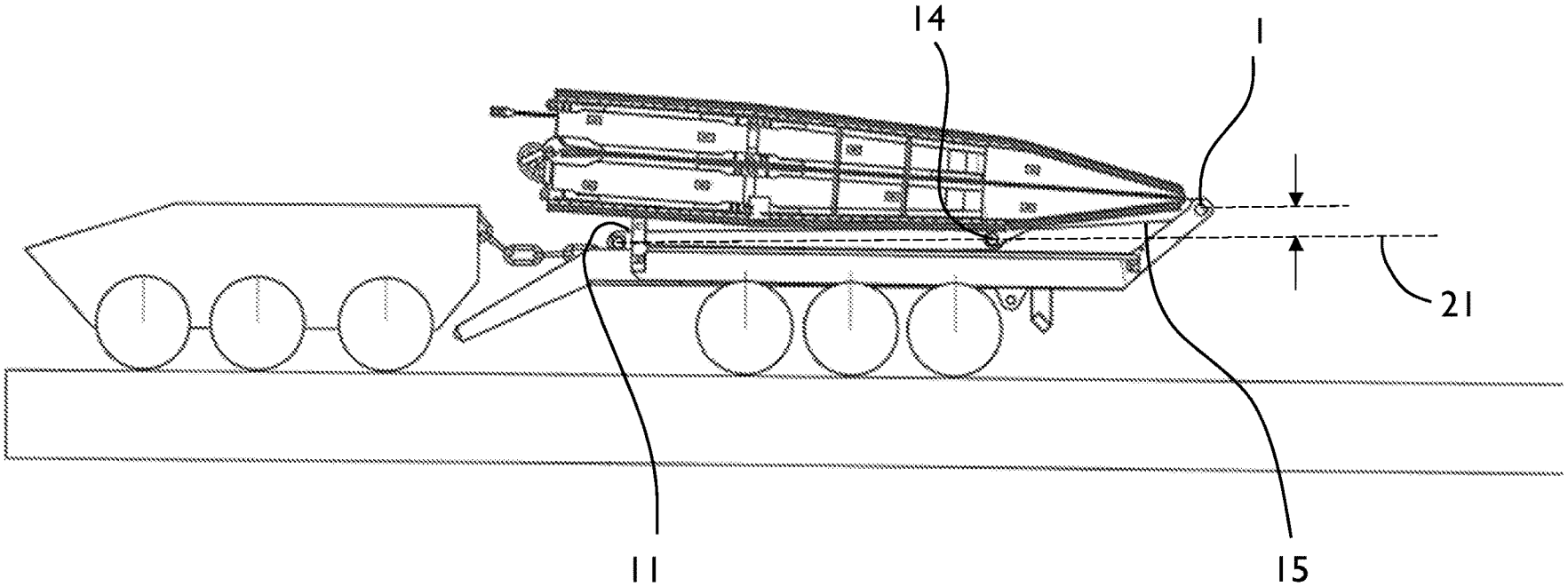
FIG. 1 shows a bridge folded and stowed on the transporting trailer in accordance with at least one embodiment.

Referring now to the drawings, FIGS. 1 to 9 show an embodiment formed in accordance with the present invention. A trailer bridge launch mechanism is illustrated, it being understood that the same principles could equally well be applied directly on a vehicle chassis.

Figure 7:
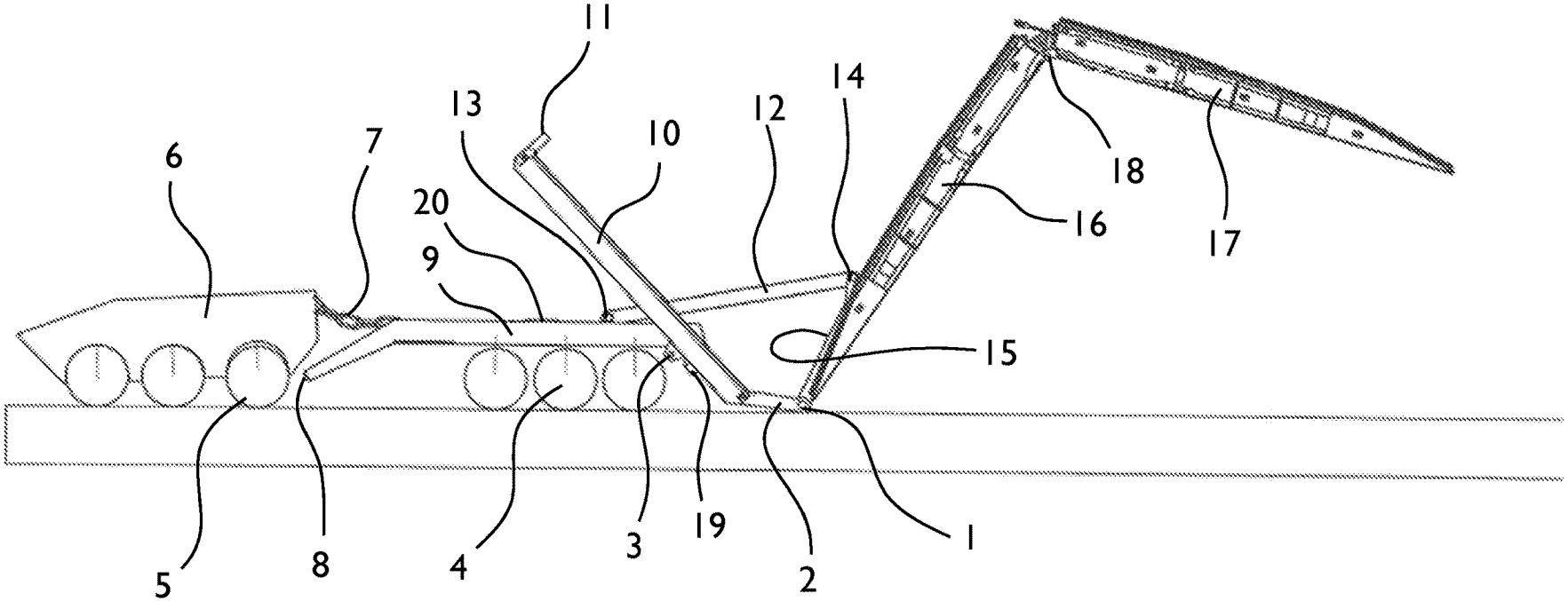
FIG. 7 shows a further step of the bridge launch procedure of the bridge of FIG. 1.

The main features are best seen on FIG. 7, showing the bridge mid launch:

1. Pivot joint between the support foot (2) and the bridge interface probe (15)
2. Support foot which is rigidly attached to the main bridge stowage pallet (10)
3. Pivot joint between the bridge stowage pallet (10) and the trailer chassis (9)
4. Trailer wheel
5. Vehicle wheel
6. Vehicle chassis
7. Chain
8. Tow hitch
9. Trailer chassis
10. Bridge stowage pallet
11. Bridge support
12. Connecting link
13. Pivot joint between connecting link (12) and the mechanism screw thread (20)
14. Pivot joint between the connecting rod (12) and the bridge interface probe (15)
15. Bridge interface probe (a spike-like member inserted into one end of the bridge and used to help pick the bridge up)
16. Bridge half section
17. Bridge half section
18. Pivot joint between bridge half sections (16 & 17)
19. Travel stop rigidly attached to the trailer chassis (9) which limits the articulation of the bridge stowage pallet (10) about pivot joint (3)
20. Mechanism lead screw Device Operation FIG. 1 shows the bridge folded and stowed on the transporting trailer. The bridge is impaled onto a bridge interface probe (15) which is a standard military bridging feature and is supported on a bridge support (11). The vehicle (6) and trailer (9) chassis' both sit on sprung suspensions which connect to wheels/tyres (4) & (5).

Figure 2:
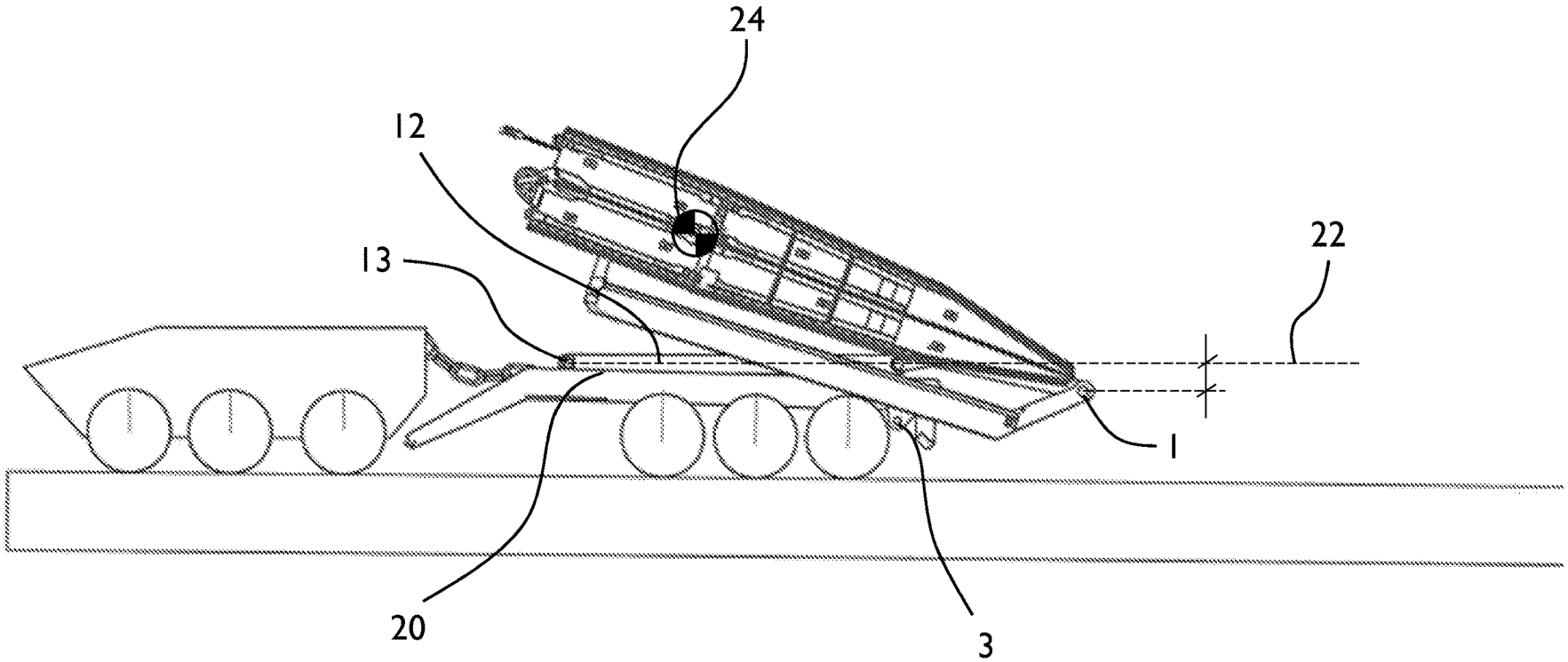
FIG. 2 shows the start of a bridge launch procedure of the bridge of FIG. 1.

FIG. 2 shows the start of the bridge launch procedure. A single linear actuator takes the form of a long powered leadscrew (20) which in this embodiment runs horizontally and the whole length of the trailer and is an integral part of the trailer chassis (9). The pivot joint 13 is connected to the lead screw so can be moved the whole length of the trailer—from front to back of the trailer chassis or from left to right in these figures. As the leadscrew moves the pivot (13) to the right, it pushes the connecting link (12) rearwards. This causes the bridge stowage pallet (10), Bridge (16, 17, 18) and the bridge interface probe (15) to pivot around the joint (3). Referring back to FIG. 1 briefly, it is significant that the line drawn along the axis of the connecting link (21) is below the pivot joint (I) so the connecting link is trying to rotate the bridge interface probe anticlockwise. The pivot (14) is arranged to bare down upon the bridge stowage pallet so that it cannot rotate anticlockwise from this location so the whole assembly is forced to rotate around pivot (3) and lift up as shown in FIG. 2.

In all the subsequence figures showing the launching sequence the leadscrew continues to move the pivot (13) to the right.

In FIG. 2, even after the line along the connecting rod axis (22) passes above the pivot (I) the mechanism continues to rotate as an assembly (bridge, bridge pallet, interface probe) about pivot (1) because the bridge mass and centre of gravity (24) provides sufficient anticlockwise moment to exceed the clockwise moment provided by the connecting link.

Figure 3:
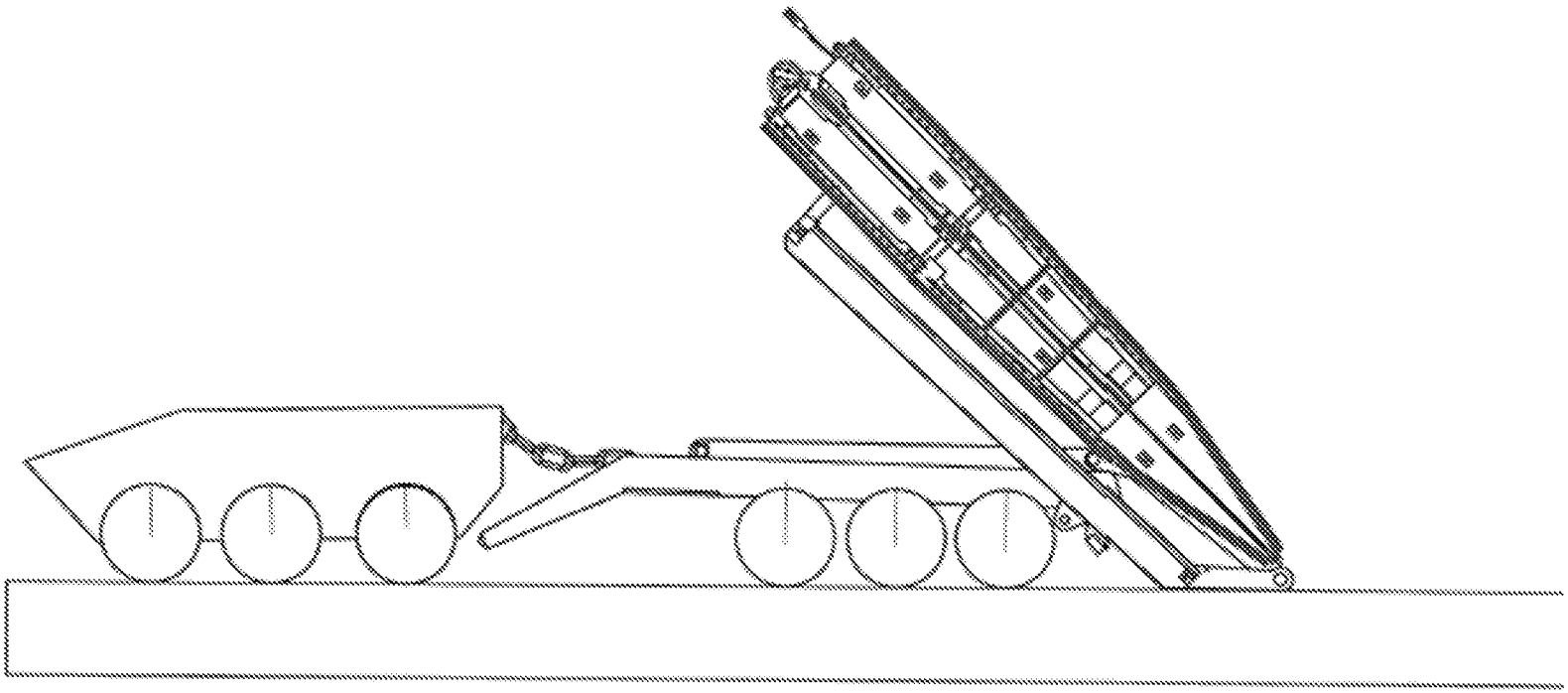
FIG. 3 shows a further step of the bridge launch procedure of the bridge of FIG. 1.

In FIG. 3 the stowage pallet has rotated sufficiently that it's extreme end touches the ground and becomes a supporting foot. The stowage pallet cannot rotate much beyond this point.

Figure 4:
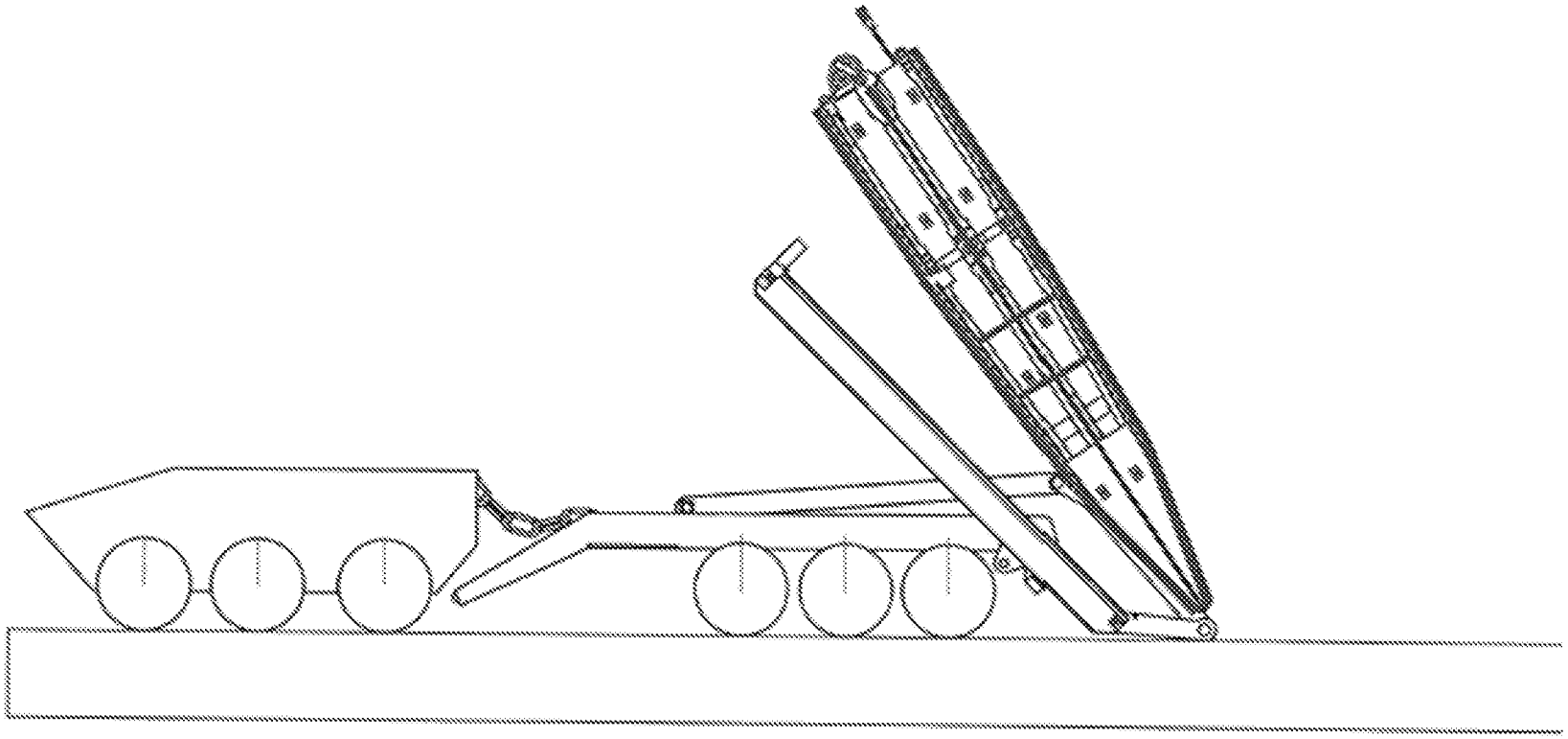
FIG. 4 shows a further step of the bridge launch procedure of the bridge of FIG. 1.

In FIG. 4 the bridge and interface probe start to rotate about pivot 1 because the stowage pallet is prevented from further rotation. The bridge lifts off its support (11).

Figure 5:
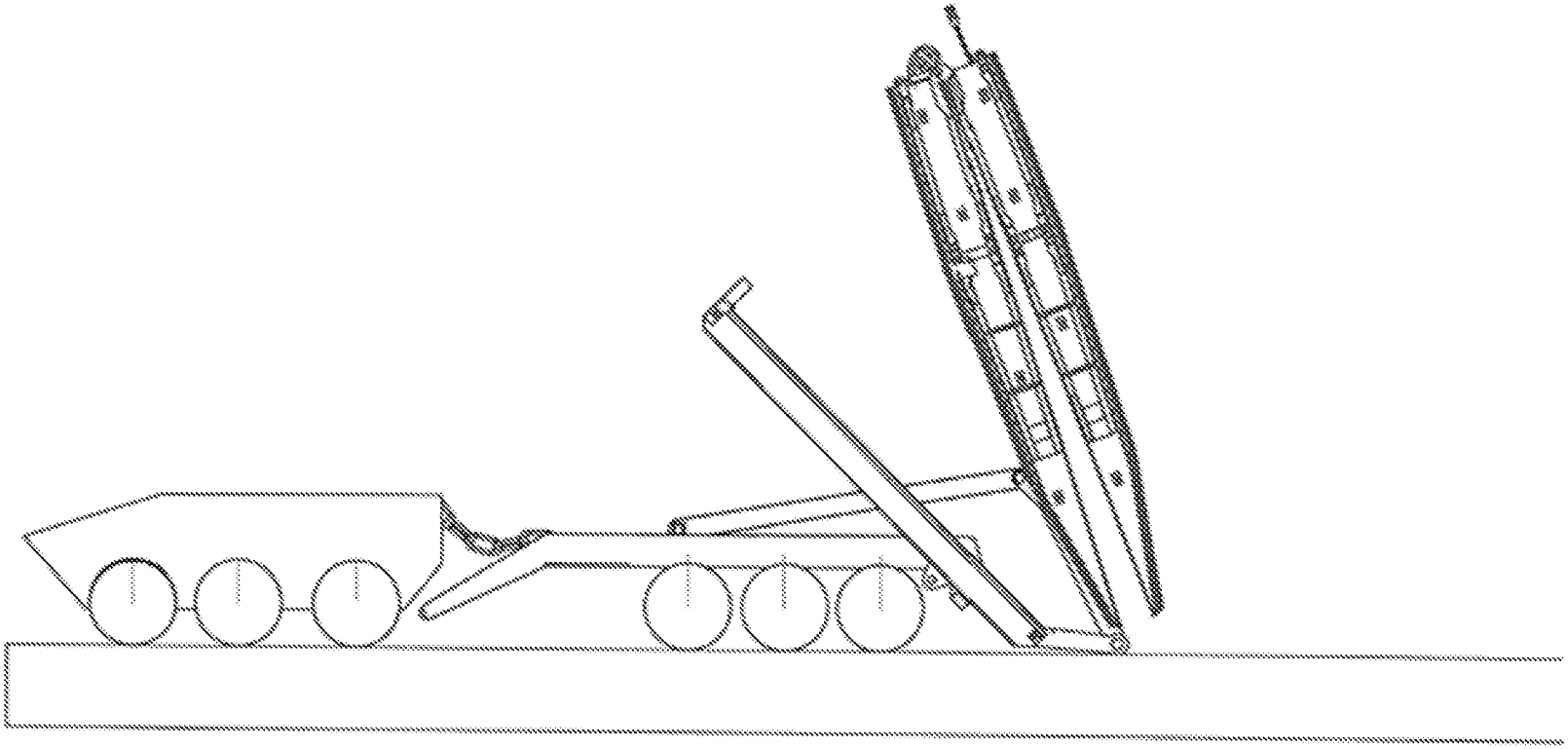
FIG. 5 shows a further step of the bridge launch procedure of the bridge of FIG. 1.

In FIG. 5 the bridge is starting to unfold. This might be caused by a connected mechanical system (discussed in optional features below), by a hydraulic system (common in service) or by some other means. The bridge C of G is still to the left of the supporting foot, the connecting rod is in compression pushing the bridge up and the weight of the bridge is bearing down on the supporting foot and on the trailer.

Figure 6:
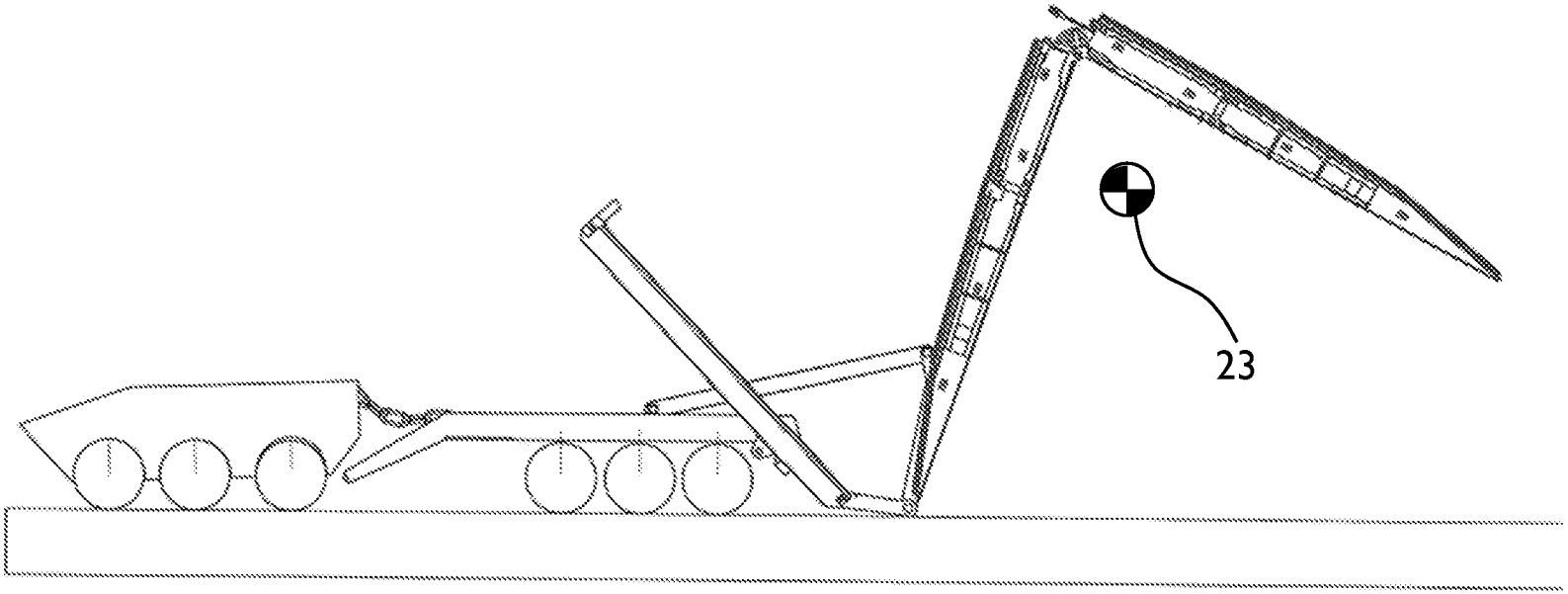
FIG. 6 shows a further step of the bridge launch procedure of the bridge of FIG. 1.

In FIG. 6 the bridge centre of gravity (23) has moved to the right of the supporting foot. The connecting rod is now in tension so it is lifting the trailer chassis. FIG. 5 showed the trailer suspension compressed (the wheels are above the chassis lower edge), in FIG. 6 the trailer suspensions have extended (the wheels are below the trailer chassis lower edge). As the bridge deploys further, there might be a danger that the trailer chassis lifts sufficiently or that the foot depresses into soft ground such that the supporting foot over rotates under the chassis. A rotation stop (19) is provided to prevent this. In FIG. 5 the stowage pallet is not quite touching the rotation stop, in FIG. 6 it is. In this design, the trailer mass can be minimised because the 'see-saw' can be balanced by a vertical force generated at the trailer to vehicle hitch lifting the rear of the vehicle. The vehicle suspension extends accordingly (the vehicle rear wheel can be seen extended slightly from the vehicle chassis.

FIG. 7 shows the same situation progressed a little further. The rear of the vehicle is lifting more and its rear suspension is extending further. If the vehicle is very lightweight its rear end may be lifted clear of the ground and the 'see-saw' may collapse. However, by adding chain (7) the possibility of this happening can be avoided.

Figure 8:
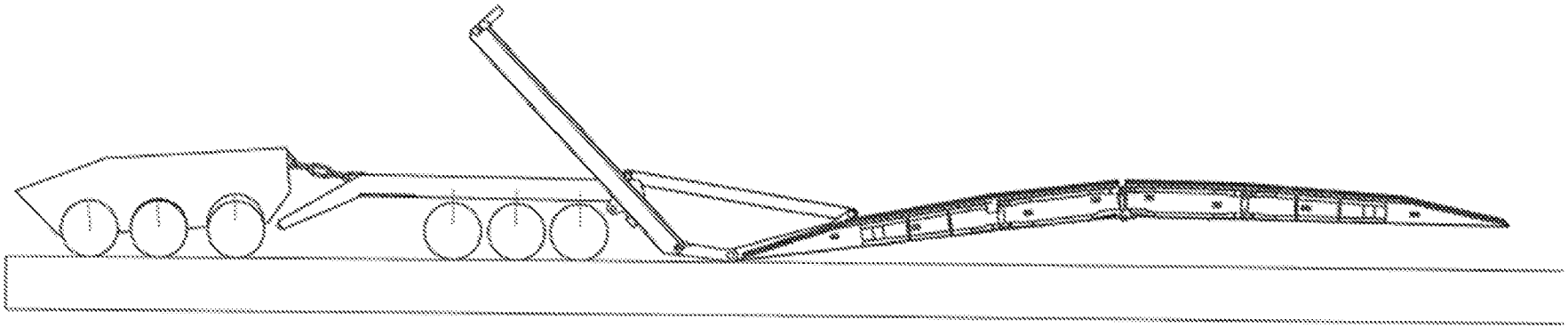
FIG. 8 shows a further step of the bridge launch procedure of the bridge of FIG. 1.

FIG. 8 shows the most highly loaded position with the bridge just about to land. In this position the chain (7) has been pulled tight so the see-saw is trying to lift the whole mass of the vehicle, not just it's rear end.

Figure 9:
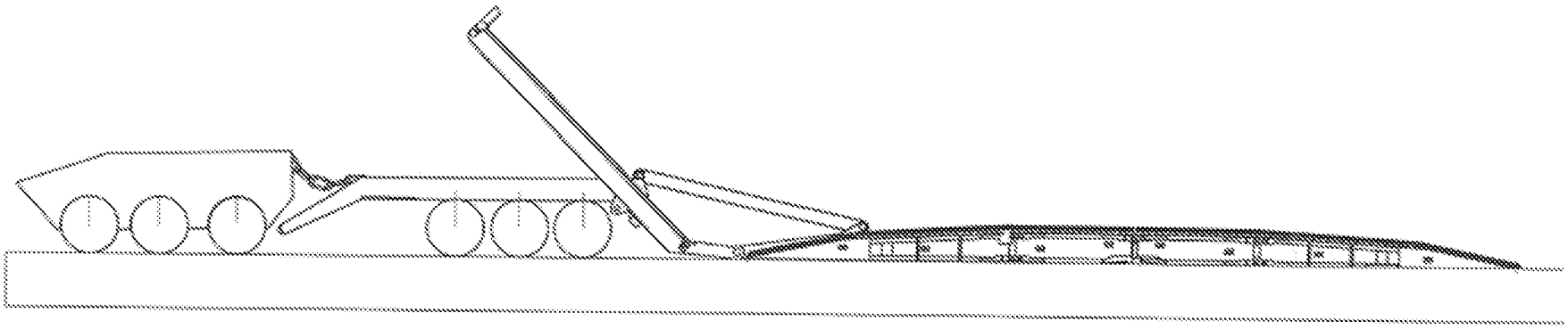
FIG. 9 shows the completed bridge launch procedure of the bridge of FIG. 1.
Figure 10:
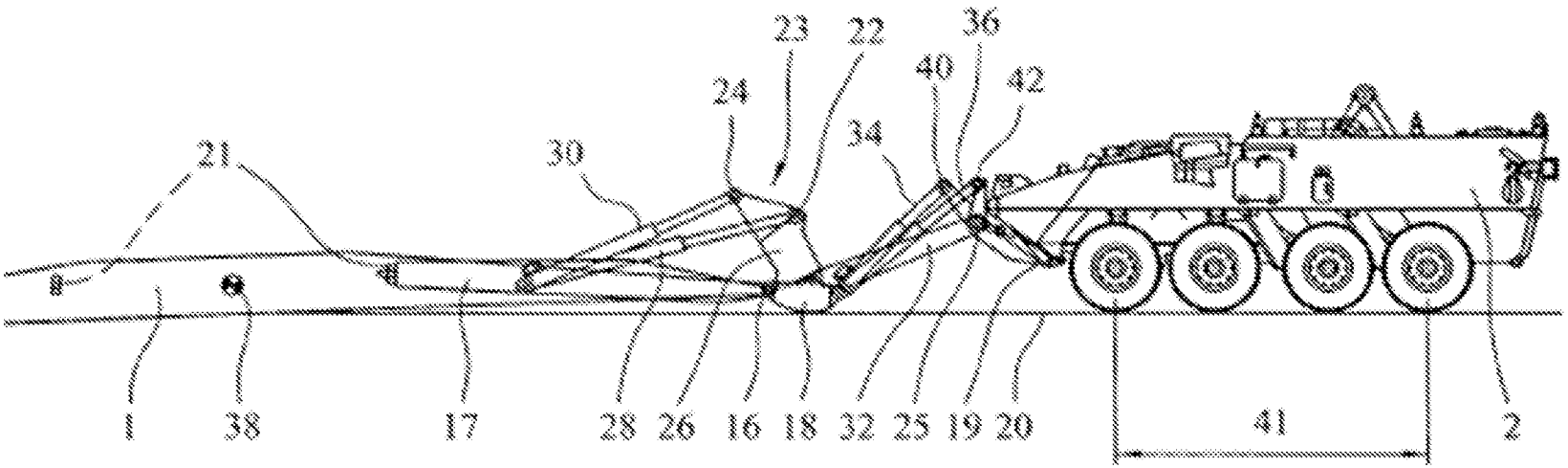
Figure 10 PRIOR ART
FIG. 10 shows an example of a prior art method of bridge deployment.
Figure 11:
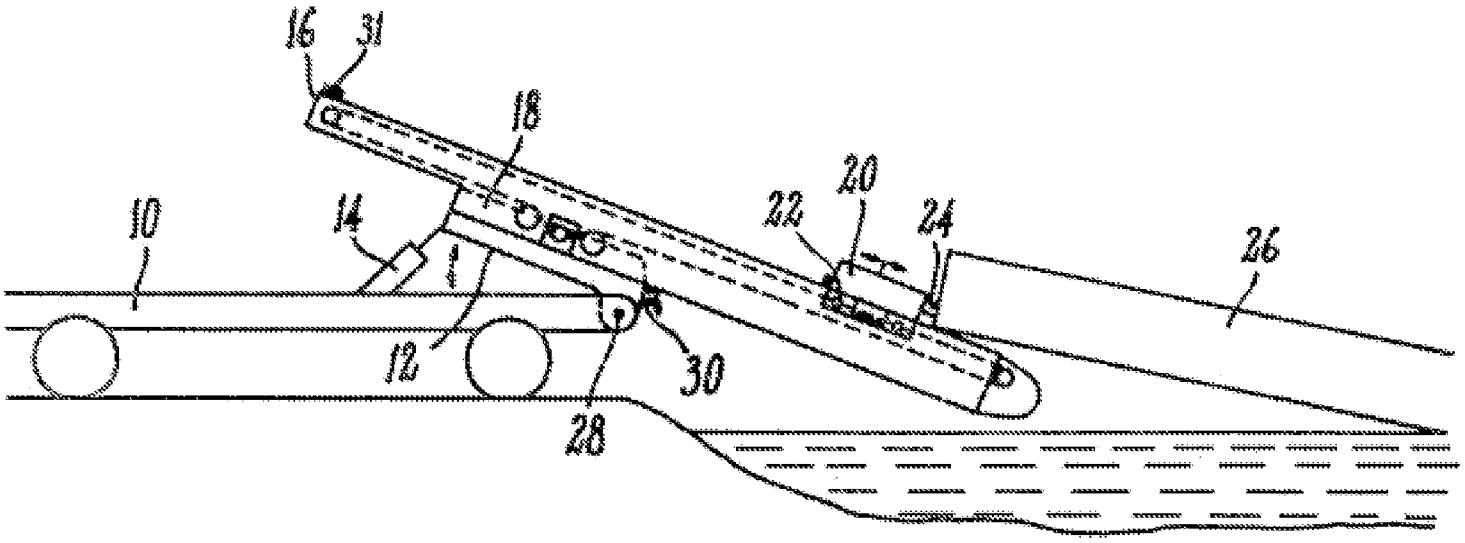
Figure 11 PRIOR ART
FIG. 11 shows another example of a prior art method of bridge deployment.

FIG. 9 shows the bridge on the ground (or crossing a gap). The mechanism is no longer supporting the bridge and has unloaded. Vehicle and trailer suspensions has returned to their normal positions and the chain (7) is slack. The vehicle and trailer combination can now move forwards (to the left in the figure) which will disengage the interface probe from the bridge.

Bridge recovery is achieved by reverse of bridge launch sequence.

Optional Features

The system could be fitted directly onto a vehicle rather than on a trailer

The chain (7) may not be required if the vehicle is sufficiently heavy.

The system can launch single piece bridges or two (or more) piece 'scissor' bridges.

When launching scissor bridges (as shown in this embodiment), the bridge opening could preferably be powered and controlled by the single actuator of the bridge launch mechanism. Scissor bridges currently in service typically have an integral hydraulic cylinder used to open and close them. This is connected to the bridge launching vehicle by a quick connect/disconnect hydraulic hose connection. During the launch, the launching vehicle supplies hydraulic oil to the bridge cylinder which extends or contracts and possibly via cables and pulleys opens the bridge from its folded arrangement to its deployed shape. This has several disadvantages. The hydraulic connections which are made and broken during each launch/recover must be kept clean to avoid contamination of the oil which can damage hydraulic systems leading to their failure. The supply of the oil needs to be timed accurately to ensure the bridge opens/closes at the correct time. Numerous vehicles may launch numerous bridges which will result in cross contamination of oil present in the vehicles and the bridges. Hydraulic oil need periodic renewal and this cross contamination makes it impossible to know when this should occur. Hydraulic oil viscosity varies with temperature and can be excessively viscous at very low temperature.

A 'warm' vehicle recovering a 'cold' bridge will have to circulate oil of very different temperature and viscosity which may require more complex valves or controls. Thus an optional addition to the single actuator bridge launch mechanism described here is a scissor bridge with integral leadscrew instead of the traditional hydraulic cylinder. This leadscrew may be powered via a direct mechanical power take of (PTO) drive from the launching mechanism. The whole system is thus mechanically geared together and the timing of the sequence is thus fixed to the operation of the single powering actuator.

Although illustrative embodiments of the invention have been disclosed in detail herein, with reference to the accompanying drawings, it is understood that the invention is not limited to the precise embodiments shown and that various changes and modifications can be effected therein by one skilled in the art without departing from the scope of the invention.

The invention claimed is:

1. A launch and recovery mechanism for a deployable bridge comprising one or more bridge sections movable from a stowed position on a vehicle to a deployed position, wherein said recovery mechanism has only a single actuator, said single actuator powers and controls bridge deployment using a launch sequence, in which bridge recovery is powered and controlled by said single actuator, and in which bridge recovery is achieved by the reverse of said launch sequence.

2. A launch and recovery mechanism as claimed in claim 1, further comprising a bridge interface probe.

3. A launch and recovery mechanism as claimed in claim 1, said launch and recovery mechanism being provided on or by the vehicle.

4. A launch and recovery mechanism as claimed in claim 1, wherein said vehicle is a trailer.

5. A launch and recovery mechanism as claimed in claim 1, wherein said recovery mechanism has only a single degree of freedom and achieves bridge launch with said single actuator which does not require a sequencing control mechanism.

6. A launch and recovery mechanism as claimed in claim 1, in which the recovery mechanism comprises a stowage pallet.

7. A launch and recovery mechanism as claimed in claim 6, in which the stowage pallet is pivotably connectable to the vehicle so as to be rotatable about a single point and the bridge is pivotably connected to the stowage pallet.

8. A launch and recovery mechanism as claimed in claim 1, in which said single actuator is a linear actuator.

9. A launch and recovery mechanism as claimed in claim 8, in which said linear actuator comprises long powered leadscrew.

10. A mobile bridge system comprising a deployable bridge consisting of one bridge section movable from a stowed position on a vehicle to a deployed position on the ground, the system comprises a bridge launch and recovery mechanism, the bridge launch and recovery mechanism consisting of a single actuator, said single actuator powers and controls deployment of the bridge section using a launch sequence, and bridge recovery is powered and controlled by the single actuator, and in which bridge recovery is achieved by the reverse of said launch sequence.

11. A mobile bridge system as claimed in claim 10, in which the bridge section is inverted during deployment.

12. A mobile bridge system as claimed in claim 10, in which the bridge section is stored upside down and flipped the right way up during deployment.

13. A mobile bridge system as claimed in claim 10, in which the recovery mechanism is provided on or by the vehicle.

14. A mobile bridge system as claimed in claim 13, in which the vehicle is a military vehicle.

15. A mobile bridge system as claimed in claim 13, in which the vehicle is a trailer which can be towed and/or pushed by a powered vehicle.

16. A mobile bridge system as claimed in claim 15, wherein the powered vehicle provides ballast for the trailer during bridge deployment and recovery.

17. A mobile bridge system as claimed in claim 10, in which the recovery mechanism comprises a stowage pallet.

18. A mobile bridge system as claimed in claim 17, in which the stowage pallet is pivotably connectable to the vehicle so as to be rotatable about a single point and the bridge is pivotably connected to the stowage pallet.

19. A mobile bridge system for deploying a bridge from a vehicle or a vehicle trailer comprising a deployable bridge comprising a plurality of bridge sections being movable from a stowed position to a deployed position, the mobile bridge system comprises a bridge launch and recovery mechanism, the bridge launch and recovery mechanism having only a single actuator, said single actuator powers and controls deployment of a first bridge section using a launch sequence.

20. A system as claimed in claim 19, in which once all of the traffic has crossed, the vehicle crosses the deployable bridge itself and reattaches to said deployable bridge on the other side, in which bridge recovery is powered and controlled by said single actuator, and in which bridge recovery is achieved by the reverse of said launch sequence.

* * * * *